US005338402A

United States Patent [19]

Devic et al.

[11] Patent Number: 5,338,402

[45] Date of Patent: Aug. 16, 1994

[54] PROCESS FOR PREPARING A BLEACHED CHEMITHERMOMECHANICAL PULP

[75] Inventors: Michel Devic, Sainte-Foy-Les-Lyon; Robert Angelier, Echirolles, both of France

[73] Assignee: Societe Atochem, France

[21] Appl. No.: 957,636

[22] Filed: Oct. 6, 1992

Related U.S. Application Data

[63] Continuation of Ser. No. 734,041, Jul. 18, 1991, abandoned, which is a continuation of Ser. No. 195,192, May 18, 1988, abandoned.

[30] Foreign Application Priority Data

May 25, 1987 [FR] France ..... 87 07552

[51] Int. Cl.[5] ..... D21C 3/14; D21C 9/16; D21B 1/16

[52] U.S. Cl. ..... 162/24; 162/25; 162/26; 162/78; 162/80; 162/83; 162/84

[58] Field of Search ..... 162/72, 80, 83, 70, 162/24, 25, 26, 84

[56] References Cited

U.S. PATENT DOCUMENTS

| | | | |
|---|---|---|---|
| 3,284,283 | 11/1966 | Kindron et al. | 162/25 |
| 3,384,535 | 5/1968 | Kindron et al. | 162/76 |
| 3,507,743 | 4/1970 | Cartsunis et al. | 162/80 |
| 3,933,676 | 1/1976 | Wade | 162/83 |
| 3,981,765 | 9/1976 | Kruger et al. | 162/86 |

FOREIGN PATENT DOCUMENTS

| | | | |
|---|---|---|---|
| 0187477 | 12/1984 | European Pat. Off. | 162/84 |
| 0172135 | 7/1985 | European Pat. Off. . | |
| 59701 | 7/1969 | Luxembourg . | |

OTHER PUBLICATIONS

Tappi Journal, vol. 68, No. 2, Feb. 1983, pp. 64–68.

Abstracts Bulletin of The Inst. of Paper Chemistry, vol. 48, No. 11, May 1978, p. 1187, Abst. 11.703.

Kutney, "Sulphur Dioxide and Its Derivatives: The Forgotten Bleaching Chiemcals", *J. Pulp & Paper Sci*, vol. 12, No. 2, pp. 44–49; Mar. 1986.

Rydholm; *Pulping Processes*, Interscience Publishers, N.Y. 1967 pp. 473–475.

*Primary Examiner*—Steve Alvo

*Attorney, Agent, or Firm*—John L. Sigalos

[57] ABSTRACT

A process for preparing chemithermomechanical pulp comprising subjecting a lignocellulosic substance from which said pulp is to be formed to the simultaneous action of a sulfite and a reducing agent that is more electronegative than the sulfite ion during a nondestructive cooking operation at a temperature of about 100° C. or above under saturated steam pressure; said simultaneous action taking place at an initial pH of between 7 and 12.5.

10 Claims, No Drawings

PROCESS FOR PREPARING A BLEACHED CHEMITHERMOMECHANICAL PULP

This application is a continuation of application Ser. No. 07/734,041 filed Jul. 18, 1991, which in turn is a continuation of application Ser. No. 07/195,192 filed May 18, 1988, both abandoned.

BACKGROUND OF THE INVENTION

The present invention pertains to a process for preparing chemithermomechanical pulp and more particularly chemithermomechanical pulp that can be easily bleached using hydrogen peroxide in an alkaline medium.

To produce a pulp, the cellulosic substance, such as wood in the form of chips, is subjected to concurrent of separate mechanical, chemical or thermal operations.

The mechanical-type pulp of high-yield pulp is manufactured by mechanically grinding the lignocellulosic substance, for example, in a stone-type grinder or disc-type grinder or refiner.

Chemithermomechanical pulp, the preparation of which is referred to in this invention and called "CTMP" pulp in the text that follows, is produced by adding to the aforementioned mechanical process a nondestructive cooking operation of a lignocellulosic substance at a temperature equal to or greater than 100° C. under saturated water steam pressure in the presence of sodium sulfite or sodium bisulfite or, more generally, a mixture of sulfur dioxide ($SO_2$) and sodium hydroxide (NaOH), all referred to in the text that follows as "sulfite", unless otherwise specified.

The CTMP pulp is of a certain interest for the industry as it provides a valid compromise between mechanical pulp and chemical pump, per se.

For example, the CTMP pulp yield, pulp weight in dry state with respect to the weight of the starting substance in dry state, is generally greater than 85% and most often, at least equal to about 90%. This makes them very close to purely mechanically produced pump which is defined herein as pulp produced by the "nondestructive cooking of the substance".

However, the bleaching of the CTMP pulp, an operation required to obtain the required quality in this area of commercial products, poses a problem. Actually, this bleaching using hydrogen peroxide in an alkaline medium, for example, leads to inadequate results, probably due to the detrimental effects of heat to which the lignocellulosic substance is first subjected, particularly during the cooking operation defined above.

The aforementioned description is given in more detail, for example in the book by James F. CASEY, PUMP AND PAPER CHEMISTRY AND CHEMICAL TECHNOLOGY, 3rd ed. Vol. I, 1980, pp. 242–250, 654, 665.

For example, French Patent No. 1,150,451 recommends cooking at a temperature of up to 150° C. using sulfite and hydrosulfite in an acidic medium. A possible bleaching of the ground pulp would be facilitated, but no particulars are given in this regard.

French Patent No. 1,389,308 notes that an improvement in the bleaching can be expected when treatment with an acid solution of the bisulfite ion $HSO_3^-$ is followed by a treatment, also in an acidic medium and without saturated water steam pressure, using sulfite in the presence of sodium borohydride which is preferred to hydrosulfite. The presence of sodium borohydride with sulfite in the first treatment is harmful and even leads to a less satisfactory result than that obtained when the sulfite is used alone in both treatments. Bleaching with $H_2O_2$ of a pulp prepared according to the recommended mode leads to a degree of whiteness of well below 80%.

Finally, U.S. Pat. No. 3,981,765, which describes and completes the corresponding French Patent No. 2,186,984, states that when the intervention of sodium borohydride takes place in an alkaline medium, with or without sulfite, it is necessarily carried out in a medium having an initial pH of over 13, and should be followed, or preferably preceded by that of an acidic aqueous solution of $SO_2$ or bisulfite. The procedure described is of practical interest only for hardwoods. Nothing is mentioned concerning the effect on the pulp by combining the alkaline treatment described with an alkaline treatment in the presence of hydrogen peroxide.

It is revealed in the known technique that, in a procedure for preparing a pulp prior to bleaching, which includes the use of sulfite and an agent such as hydrosulfite or borohydride, it is necessary to maintain a constant acidification phase.

Since the use of $H_2O_2$ permits the bleaching of the pulp obtained using sulfite until it reaches a high level of whiteness, the industry is not interested in the combined action of sulfite with agents such as hydrosulfite or borohydride. As is known, the latter actually, amongst other things, results in a complication of the process, an additional consumption of $SO_2$ or of bisulfite, and an increase in the pollution factor.

SUMMARY OF THE INVENTION

This invention avoids the drawbacks of past processes while improving the results of current procedures for preparing bleached pulp until it reaches a high degree of whiteness using hydrogen peroxide.

The present invention aims to obtain CTMP pulp which, when bleached with hydrogen peroxide, generally has a degree of whiteness exceeding 80% of 80°, except in special cases understandable by the expert, which percentage is today usually measured at a wavelength of 457 nm with magnesium oxide as a reference standard using a General Electric or Elrepho spectrophotometer.

This invention is first a process for manufacturing CTMP pulp using sodium sulfite or sodium bisulfite or a mixture of sulfur dioxide and sodium hydroxide and a reducing agent that is more electronegative than the sulfite ion, which consists of combining a nondestructive cooking of the cellulosic substance at a temperature equal to or greater than 100° C. under saturated steam pressure, using sulfite, bisulfite or mixture and said reducing agent. The invention is characterized in that the action of said sulfite, bisulfite or mixture and said reducing agent on the lignocellulosic substance is simultaneous and in an initial pH medium between 7 to 12.5, and leads to a manufactured pulp that can be bleached using hydrogen peroxide in an alkaline aqueous medium.

DETAILED DESCRIPTION

The reducing agent is most often selected from thiourea dioxide (or formamidinesulfinic acid), sodium borohydride and sodium dithionite (or sodium hydrosulfite).

We may refer, for example, to the thesis defended on Dec. 6, 1985 at the University Claude Bernard-Lyon-1 by Odile CHALMIN LOUIS-ANDRE: "Reducing Properties of Sodium Oithionite under Phase Transfer Conditions" to estimate the electronegativity of dithionite or thiourea dioxide.

The quantity of reducing agent used may vary dependent upon its nature. It is generally between 0.1% and 5% in the case of thiourea dioxide or dithionite. This quantity, like any quantity in the description that follows, is expressed in weight percent relative to the weight of lignocellulosic substance in dry state, unless otherwise specifically stated. Sodium borohydride is used in an amount of about 0.01% to 0.5%. This reducing agent is conveniently used in the form of an aqueous solution such as a solution containing 12 wt. % of sodium borohydride marketed under the name BOROL ® by the VENTRON Corporation.

The cooking temperature according to the invention may reach 200° C. It is most often selected to be between 120° C. and 160° C.

The pressure is virtually equal to that corresponding to the pressure of the water steam at cooking temperature.

During the cooking, the quantity of molecular oxygen, like the oxygen of the air, in particular that included in the lignocellulosic substance, should obviously be minimized. This is accomplished in a known manner using water steam or compression, for example, as specified among others in the book already cited by James P. CASEY, p. 213, which also describes equipment on pp. 219–229, specifically pressure-resistant equipment, suitable for preparing CTMP pulp.

The quantity of sulfite used is that usually used in processes not included in the invention and known for being suitable for preparing CTMP pulp. Consequently, it is between about 0.1% and 10%, most often between 1% and 6%, expressed relative to $SO_2$.

The cooking according to this invention may be performed before, during or after a grinding or mechanical refining operation.

For example, according to this invention the cooking of the starting lignocellulosic substance, such as wood chips, may be followed by mechanical grinding which continues the initiated action or is performed at low temperature at atmospheric pressure.

For example, wood chips may be impregnated cold in a known manner using an aqueous solution of reagents necessary for preparing this invention, then cooked according to this invention, and finally ground as specified above.

For example, the cooking according to this invention begins in the grinder or mechanical refiner which feeds the starting lignocellulosic substance, for example, wood chips or said substance already in the form of a pulp by grinding, to be further completed, if necessary.

For example, the cooking according to this invention may be applied to a pulp after grinding-refining the starting lignocellulosic substance, such as wood chips.

The consistency, in wt. % of lignocellulosic substance in dry state in the medium, is not a critical factor for carrying out this invention. In practice, and according to the technical methods adopted, it is between about 5% and 50% and, generally, between 5% and 25% in the case of a previously ground substance.

The cooking time according to this invention will vary and depends on other preparation methods, including the type of equipment used. It most often does not exceed about one hour and is generally between a few tens of seconds and 30 minutes.

This invention also includes the bleaching of the pulp manufactured as described above, which includes the washing of said pulp to eliminate, as much as possible, the sulfite ions, the reducing agent, and the action of hydrogen peroxide on this wood pulp in an alkaline medium.

The advantage of this invention is that it improves the capability of the pulp to reach a high degree of whiteness.

The washing is carried out in a known manner, for example, in a single or repeated sequence of diluting the pulp in water and reconcentrating the pulp by pressing or filtration.

We may refer, for example, to the article of H. KRUGER, H. U. SUSS in Tappi, 1982 International Sulfite Pulping Conference, Toronto, Oct. 20–22, 1982, pp. 143–148, to judge the significance given to this washing.

The bleaching is, for example, carried out by adding about 0.5% to 10%, preferably 2% to 6% hydrogen peroxide in the presence of about 1% to 6% of a sodium silicate solution with a density of 1.33 at pH between about 9 and 11, at a temperature between 40° C. and 100° C. for about 0.5 to 2 hours, with a consistency between 10% and 30%. The bleaching solution may contain additives such as essentially one or more chelating or sequestering agents such as the diethylenetriaminepentaacetic and ethylenediaminetetraacetic acids in the form of sodium salts in quantities generally between about 0.1% and 1%. Prior to bleaching the pulp may also be subjected to a treatment with the chelating or sequestering agents as described above, depending on the nature and quantity used, at a temperature between 20° C. and 100° C., preferably between 50° C. and 95° C. so as not to have to work under pressure while maintaining a fast enough chelation or sequestration rate, with a consistency between about 5% and 30% for periods that may vary from about five minutes to two hours, and preferably followed by a washing, for example, by pressing.

The cooking according to this invention may itself be preceded by a treatment of the lignocellulosic substance using a chelating or sequestering agent of the type described above. The consistency may then vary between about 5% and 50%, generally without being greater than about 25% to 30% when the substance treated was first subjected to a mechanical grinding operation. Such a treatment helps to increase the intrinsic effect of this invention the degree of whiteness after bleaching and on the efficiency of the hydrogen peroxide action.

It is also possible to place the lignocellulosic substance in the presence of a chelating or sequestering agent at the time of the cooking according to this invention.

The invention will be further described in connection with the following examples which are set forth for purposes of illustration only.

(i) The quantities are expressed in wt. % with respect to the lignocellulosic substance in dry state, unless otherwise specified or demonstrated;

(ii) When, prior to cooking, a treatment is applied using a chelating or sequestering agent, called "sequestering treatment", it is carried out, unless otherwise stipulated, at 90° C. for 15 minutes, with a consistency of 10% using 0.5% of an aqueous solution containing 40 wt. % of the sodium salt of diethylenetriaminepentaacetic acid, referred to as DTPA;

(iii) The initial pH of the cooking medium and, if necessary, that of the aqueous impregnation solution containing the sulfite and the reducing agent, is between 7 and 12.5;

(iv) The sodium borohydride is applied in the form of BOROL® and the quantity specified is that desired herein;

(v) "Silicate" refers to an aqueous solution of sodium silicate having a density equal to 1.33;

(vi) The degree of whiteness is measured (457 nm) using an ELREPHO spectrophotometer manufactured by KARL ZEISS.

EXAMPLE 1

Ground softwood chips having a degree of whiteness equal to 53.7% are cooked in an autoclave under saturated water steam pressure at 120° C. for 0.5 hour, with a consistency of 20%, in the presence of 5.9% sodium sulfite ($Na_2SO_3$), 2.5% sodium hydrosulfite at pH 10.5 with 2% sodium hydroxide.

The cooking is followed by a washing with water to remove the sulfite ions and the reducing agent. The CTMP pulp obtained is then bleached at 90° C. for 2 hours to a consistency of 20% using 5% hydrogen peroxide ($H_2O_2$), 2% sodium hydroxide, 4% silicate, and 0.5% DTPA.

The degree of whiteness thus obtained is equal to 82.8%.

By processing as above, except for the cooking which is carried out without hydrosulfite for the purpose of comparison, and using a quantity of sodium bisulfite equal to 5% and a quantity of NaOH equal to 1.2%; i.e., a $SO_2$/NaOH ratio considered to be optimum in such a case, the degree of whiteness obtained is only 81%, while consuming 1.05 times more $H_2O_2$.

EXAMPLE 2

The same lignocellulosic starting substance as in Example 1 is subjected to a sequestering treatment, then is washed with water. It is then treated as described in Example 1.

The final degree of whiteness obtained is 83.3% when the cooking prior to bleaching includes the combined action of hydrosulfite with sulfite. It is only 81% by adopting the cooking conditions defined for the comparison test in Example 1, while consuming 1.12 times more $H_2O_2$.

EXAMPLE 3

Example 2 is repeated in the case of the combined action of hydrosulfite with sulfite, but with a cooking temperature of 140° C. rather than 120° C.

The degree of whiteness thus obtained is still high and equal to 82.6%.

EXAMPLE 4

The lignocellulosic starting substance of Example 1 is successively subjected to the sequestering treatment, washing with water, cooking carried out under saturated steam pressure at 120° C. for 0.5 hour, the consistency being 20%, in the presence of both 1.5% BOROL® and 5.9% sodium sulfite at pH 4, followed by a washing in water to remove the sulfite and reducing agent. The CTMP pulp obtained is then bleached in the same manner following the combined hydrosulfite and sulfite action in Example 1.

The degree of whiteness obtained is then 84.5%.

It is still 82% when the bleaching is modified in terms of the quantities of $H_2O_2$, NaOH and silicate which become, respectively, 2%, 1%, and 3%.

EXAMPLE 5

The process of Example 4 is carried out, but modified in that the quantity of BOROL® is decreased from 1.5% to 1% and that the sodium bisulfite, used in a 5% concentration, replaces the sodium sulfite and the pH is 8.

The CTMP pulp obtained is bleached in the same manner following the combined hydrosulfite and sulfite action in Example 1. The degree of whiteness obtained after bleaching is 82.7%.

EXAMPLE 6

Example 5 is repeated, but with 3% BOROL® rather than 1% and the pH is 8.5. The degree of whiteness is then equal to 83.8%.

EXAMPLE 7

250 kg/h of ground softwood chips are subjected to a chelating treatment at 90° C. using 0.5% DTPA, the consistency being 40%, then are washed by pressing and cooked in an autoclave under a saturated water steam pressure under a combined action of 1.5% BOROL® with 2.5% sodium bisulfite neutralized with sodium hydroxide having a pH of 10.8. The cooking begins at a temperature of 140° C. for 5 minutes, then is completed at a temperature of 100° C. for 1 hour. After washing with water to remove the sulfite ions and the reducing agent, the CTMP pulp is bleached to a consistency of 28%, at 80° C. for 1 hour using 5.1% $H_2O_2$, 2% NaOH, 4% silicate and 0.5% DTPA.

After refining in a disc refiner and screening, the degree of whiteness of the CTMP pulp obtained is 80%. The tensile stress strength, or rupture length is 3,835 m.

By repeating the process described above, but omitting BOROL®, the degree of whiteness is only equal to 77%, however using 5.4% $H_2O_2$ and the breaking length is only 3,290 m.

The starting chips show, after grinding in the absence of any chemical reagent, a degree of whiteness equal to 55.5% and a breaking length equal to 2,755 m.

EXAMPLE 8

The process of Example 7 is repeated, but by carrying out the cooking in the combined presence of 2.5% sodium hydrosulfite with 5% sodium bisulfite neutralized with NaOH and 1% NaOH at pH 10.5, and the CTMP pulp bleached as in Example 7, but using only 4.5% $H_2O_2$ with a degree of whiteness equal to 78.5% and a breaking length of 3,525 m resulting.

EXAMPLE 9

The same lignocellulosic starting substance as in Example 1 is subjected to a sequestering treatment then is washed with water. It is then cooked according to this invention at 120° C. for 0.5 hour to a consistency of 20%, in the presence of both 1% thiourea dioxide and 5.9% sodium sulfite at pH 10.5.

After the pulp is cooked, it is washed with water to remove the sulfite ions and the reducing agent. The washed pulp obtained is then bleached in the same manner as after the combined action of hydrosulfite with sulfite in Example 1, at 90° C. for 2 hours, to a consistency of 20%, using 5% $H_2O_2$, 2% sodium hydroxide, 4% silicate and 0.5% DTPA.

The degree of whiteness thus achieved is equal to 83.5%.

EXAMPLE 10

Ground hardwood chips having a degree of whiteness of 59.9% are cooked in an autoclave under saturated water steam pressure, at 120° C. for 0.5 hour, to a consistency of 20% in the presence of both 1.5% BOROL® and 5.9% sodium sulfite at pH 11, then are washed with water to remove the sulfite and the reducing agent. The washed pulp obtained is then bleached at 90° C. for 2 hours to a consistency of 20%, using 5% $H_2O_2$, 4% silicate, and 0.5% DTPA.

The degree of whiteness obtained is equal to 86.6%.

By proceeding as above, except for the cooking which is carried out, for comparison, without BOROL®, the degree of whiteness obtained is only equal to 84.1% while also consuming 1.05 times more $H_2O_2$.

EXAMPLE 11

250 kg/h of softwood chips having undergone a grinding treatment are treated by impregnation using 0.5% DTPA at 90° C. to a consistency of 20%, washed in water by successive dilutions and pressing, then are cooked under saturated water steam pressure at 120° C. throughout the residency period of about 30 seconds in a mechanical grinder to a consistency of about 28% by a combined action of 1.5% BOROL® and 3% $SO_2$ in a mixture at pH 8.4 with sodium hydroxide, continuing at 100° C. for 30 minutes. The pulp, washed in water after cooking under successive dilutions and pressing to remove the sulfite ion and reducing agent, is finally bleached at 80° C. for 2 hours to a consistency of 26.5% using 5.2% $H_2O_2$, 2% NaOH, 4% silicate, and 0.5% DTPA.

After refining in a double-disc refiner and screening, the degree of whiteness of the bleached washed pulp is 83.6%.

By operating as above, but omitting BOROL® in the cooking, the degree of whiteness of the bleached pulp is only 80.1% while consuming 1.05 more $H_2O_2$.

EXAMPLE 12

The process of Example 11 is used, but beginning with hardwood chips and cooking under a saturated steam pressure with 2.45% $SO_2$ combined with BOROL® is a mixture at pH 11.5 with sodium hydroxide.

The degree of whiteness of the bleached pulp obtained is equal to 87.3%, the breaking length is equal to 3,235 m and the tearing index is 352.

By proceeding as above, but without using BOROL®, the degree of whiteness is only 86%. The breaking length is equal to only 2,885 m and the tearing index is 310 for the same degree of refining.

EXAMPLE 13

Example 4 is repeated on the ground softwood chips having a degree of whiteness of 62%, except that the sequestering treatment is not carried out prior to cooking, but that the latter is carried out in the presence of 0.5% DTPA, in addition to the sulfite and BOROL® at pH 11.3.

The degree of whiteness of the bleached pulp obtained is 86%; whereas, it was only 84% by proceeding as above, but without BOROL®.

EXAMPLE 14

After preheating softwood chips with water steam they are impregnated, by immersion or soaking, with 3% sodium sulfite, 3% sodium bisulfite, 1.5% BOROL®, 0.5% DTPA at pH 8.5 simultaneously and are cooked in an autoclave under saturated water steam pressure for 4 minutes at 190° C. before undergoing a mechanical grinding by sudden ejection outside the autoclave through a die and a refining in a disk refiner.

The pulp thus obtained is bleached, after washing to remove the sulfite, at 90° C. for 2 hours to a consistency of 20% using 5% $H_2O_2$, 2% sodium hydroxide, 4% silicate, and 0.5% DTPA.

The degree of whiteness of the pulp thus finally obtained is equal to 71%; whereas, the refined starting chips had a degree of whiteness of only 56%.

The proceeding as above, but without BOROL®, the degree of whiteness obtained is only equal to 66% and the breaking length is smaller (3,755 m rather than 3,900 m) for a virtually unchanged breaking length.

This invention is useful not only for manufacturing bleached CTMP pulp having a high degree of whiteness from both softwoods and hardwoods with a reduced consumption of $H_2O_2$, but, also, for preserving and even improving the mechanical properties of usual bleached pulp.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A process for preparing a bleached chemithermomechanical pulp comprising (a) subjecting a lignocellulosic substance from which said pulp is to be formed to a grinding or mechanical refining and to a cooking before, during, or after said grinding or mechanical refining by the simultaneous action of sodium sulfite, sodium bisulfite, or a mixture of sodium sulfite and sodium bisulfite and sodium borohydride as a reducing agent at an initial pH of between 8 and 12.5 and at a temperature of about 100° C. or above under saturated steam pressure to obtain a chemithermomechanical pulp having a yield, pulp weight in dry state with respect to the weight of the starting lignocellulosic substance in dry state, or greater than 85% and (b) then bleaching said lignocellulosic substance pulp by the use of hydrogen peroxide in an alkaline medium.

2. The process of claim 2, wherein the sodium borohydride is in an amount of 0.01 to 0.5 wt. % relative to the weight of lignocellulosic substance in dry state.

3. The process of claim 1, wherein the cooking is performed at temperature that does not exceed 200° C.

4. The process of claim 3, wherein the cooking temperature is between 120° C. and 160° C.

5. The process of claim 1, wherein the sodium sulfite, sodium bisulfite or a mixture of sulfur dioxide and sodium hydroxide in an amount between about 0.1% to 10% expressed as sulfur dioxide.

6. The process of claim 1, wherein the lignocellulosic substance is treated with a chelating or sequestering agent prior to or at the time of cooking.

7. The process of claim 1, wherein the lignocellulosic substance is treated with a sodium salt of diethylenetriaminepentaacetic acid prior to or at the time of cooking.

8. The process of claim 1 including washing of said pulp after cooking and prior to bleaching.

9. The process of claim 8, wherein the hydrogen peroxide is used at a pH between about 9 and 11.

10. The process of claim 9, wherein the hydrogen peroxide is used in an amount between 2 to 6 wt. % relative to the weight of lignocellulosic substance in dry state.

* * * * *

UNITED STATES PATENT AND TRADEMARK OFFICE

CERTIFICATE OF CORRECTION

PATENT NO : 5,338,402

DATED : August 16, 1994

INVENTOR(S) : Devic et al

It is certified that error appears in the above-identified patent and that said Letters Patent are hereby corrected as shown below:

Col. 8, line 41, change "or" to --of--;

Col. 8, line 44, cancel "claim 2" and substitute therefor --claim 1--;

Col. 8, line 61, after "bleaching" insert --with hydrogen peroxide--.

Signed and Sealed this

First Day of November, 1994

*Attest:*

*Attesting Officer*

Bruce Lehman

BRUCE LEHMAN

*Commissioner of Patents and Trademarks*